US005520604A

United States Patent [19]

Reist

[11] Patent Number: 5,520,604

[45] Date of Patent: May 28, 1996

[54] PROCESS AND APPARATUS FOR CREASING FOLDED EDGES OF PAPER PRODUCTS

[75] Inventor: Walter Reist, Hinwil, Switzerland

[73] Assignee: Ferag AG, Hinwil, Switzerland

[21] Appl. No.: 208,334

[22] Filed: Mar. 8, 1994

[30] Foreign Application Priority Data

Mar. 10, 1993 [CH] Switzerland ..... 00714/93

[51] Int. Cl.[6] ..... B31B 1/26

[52] U.S. Cl. ..... 493/422; 493/435; 493/442

[58] Field of Search ..... 493/405, 416, 493/422, 442, 454, 406, 424, 435

[56] References Cited

U.S. PATENT DOCUMENTS

| | | | |
|---|---|---|---|
| 3,572,689 | 7/1968 | Murphy | 270/61 |
| 3,580,562 | 1/1969 | Reist | 270/54 |
| 3,931,963 | 1/1976 | Bewersdorf | 270/61 |
| 3,955,667 | 4/1976 | Muller | 198/180 |
| 4,197,045 | 4/1980 | Stauber | 414/30 |
| 4,641,575 | 2/1987 | Cavagna | 493/442 |
| 4,795,418 | 1/1989 | Reist | 493/422 |
| 4,834,696 | 5/1989 | Marsche | 493/442 |

FOREIGN PATENT DOCUMENTS

| | | |
|---|---|---|
| 0207271 | 1/1987 | European Pat. Off. . |
| 3517775 | 1/1986 | Germany . |
| 4039998 | 6/1992 | Germany . |
| 4039997 | 6/1992 | Germany . |

*Primary Examiner*—Jack W. Lavinder
*Assistant Examiner*—Christopher W. Day
*Attorney, Agent, or Firm*—Walter C. Farley

[57] ABSTRACT

The folded edges (F) of paper products (P), such as newspapers and magazines, are creased in accordance with the process of the invention, in that at least one pair of creasing tools (W. 1, W.2) act at a creasing point from either side against the folded edge and the creasing point is moved along the folded edge (F) by a relative movement between the product (P) and at least one of the creasing tools. The facing creasing surfaces of the creasing tools (W.1, W.2) are advantageously designed and arranged in such a way that the folded edge is curved at the creasing point, which is achieved in that a perpendicular on the creasing surfaces forms an acute angle at the creasing point with the movement direction (B) of the latter. The creasing tools can also be pressed against one another with a pressing force. During the creasing process the product must be held by holding means. The latter simultaneously serve as conveying means, e.g. as grippers on a gripping chain, which continuously convey the products over a conveying path. With each conveying means is associated at least one pair of creasing tools, which moves over at least part of the conveying path in addition to its movement along the folded edge and substantially synchronously with the conveying means.

25 Claims, 7 Drawing Sheets

PROCESS AND APPARATUS FOR CREASING FOLDED EDGES OF PAPER PRODUCTS

FIELD OF THE INVENTION

The invention is in the field of the further processing of paper products, particularly printed products, and relates to a process and an apparatus for creasing the folded edges of folded printed products.

BACKGROUND OF THE INVENTION

There is a need to crease, i.e. more sharply define the folded edges of paper produces, particularly bundles of folded printed products such as e.g. newspapers or magazines, in order to reduce the thickness difference between the area of the folded edge and the areas of the other edges which are not folded and therefore produce products, which are easier to further process and from which it is e.g. possible to more easily produce stable stocks or layers. According to the prior art the folded printed products, e.g. arriving in the form of a scale flow from a rotary press are passed for the purpose of pressing the usually leading folded edge between one or more pressing roller pairs positioned transversely to the scale flow movement direction and the two rollers of a pair are pressed against one another with a pressing force and the folded edges are very briefly, and intensely pressed. It has been found that even when using very high pressing forces (e.g. approximately 100 to 200 kp) when using such pressing roller pairs folded edges are obtained, which in part "relax" again, i.e. still give rise to a considerable thickness difference between the area of the pressed folded edge and the other areas of the printed product. It is obvious to use the fold pressing method with transverse pressing roller pairs in the case of printed products in a scale flow formation, so that the rollers are normally positioned immediately in the rotary press discharge area, where the printed products are still very fresh. Therefore significantly higher pressing forces cannot be used for pressing the folded edges, because the quality of the printed products would be deteriorated by the sticking or smearing of the inner pages.

Other methods are known in which the folded edges are briefly pressed with high pressing forces and which in all cases only lead to edges having a limited sharpness and which are therefore only usable to a limited extent.

In order to obviate these disadvantages, as described in European patent 207271 of the same applicant, a method has been developed according to which the folded edge of folded printed products is pressed between two pressing jaws for a longer period. To enable this method to be used on continuously conveyed products, the pressing jaw pairs move over a distance with the printed products conveyed in suspended manner. It has been found that also in the case of this method a folding quality meeting higher demands can only be achieved with very high pressing forces.

SUMMARY OF THE INVENTION

An object of the invention is therefore to provide a process and an apparatus making it possible to crease the folded edges on paper products, particularly on printed products, i.e. make the said edges more sharply defined, in such a way that with lower forces sharper creases can be produced than is possible with the prior art procedures. The process must in particular be usable on continuously conveyed products, a conveying or feed flow of products being passed through the apparatus for the creasing of the folded edges.

According to the process of the invention on each side of the folded edge to be creased is positioned a creasing tool in such a way that a narrow point (creasing point) of the folded edge is located between the facing creasing surfaces of the tools, the creasing surfaces of the tools only engaging on the printed product in the vicinity), of the folded edge or are pressed against one another with a pressing force. At least one of the creasing tools has a creasing surface curved in such a way that it engages with the printed products substantially along a creasing line, said creasing line being positioned at an angle to the folded edge. The two creasing tools and their creasing surfaces are advantageously so positioned relative to the product that the folded edge is curved about the creasing line of one creasing tool. The folded edge or a predetermined part thereof is now creased, in that the creasing point is moved along the folded edge in that at least one of the creasing tools is moved along the folded edge. According to the process of the invention it is possible to obtain high crease qualities with very small forces (e.g. 3 to 5 kp).

It is also possible to crease the folded edge in that it is only pressed and not curved between the creasing tools. For continuously conveyed printed products, the creasing tools are conveyed along with the printed products over a creasing path.

BRIEF DESCRIPTION OF THE DRAWINGS

The invention is described in greater detail hereinafter relative to the process of the invention and exemplified embodiments of the apparatus according to the invention, relative to the drawings, wherein.

DESCRIPTION OF THE PREFERRED EMBODIMENTS

Figure 1A:
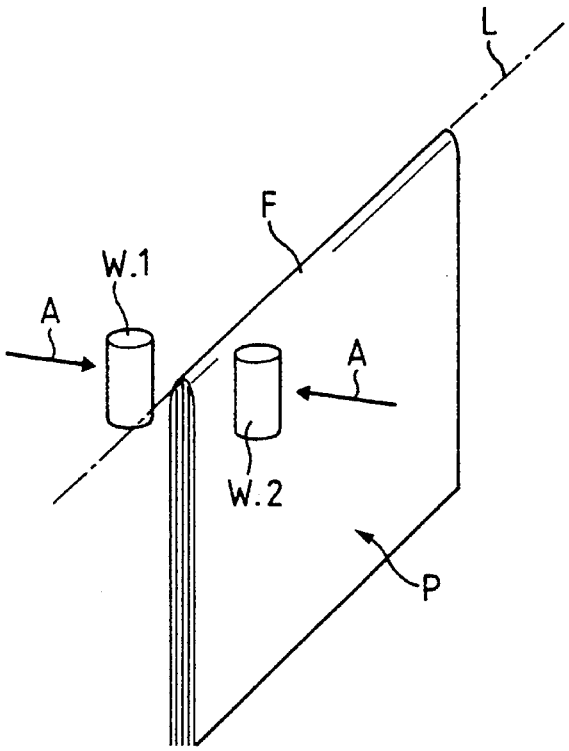
FIGS. 1*a* to 1*c* are perspective views of a printed product, whose folded edge is creased according to the creasing process according to the invention.
Figure 1B:
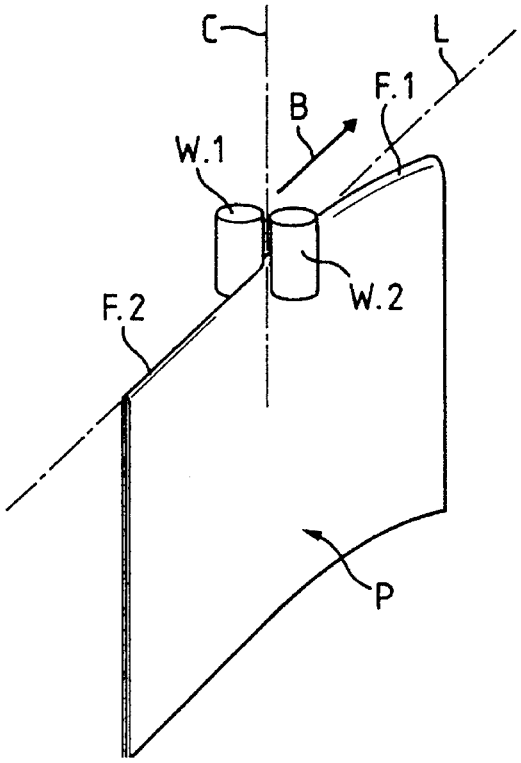
Figure 1C:
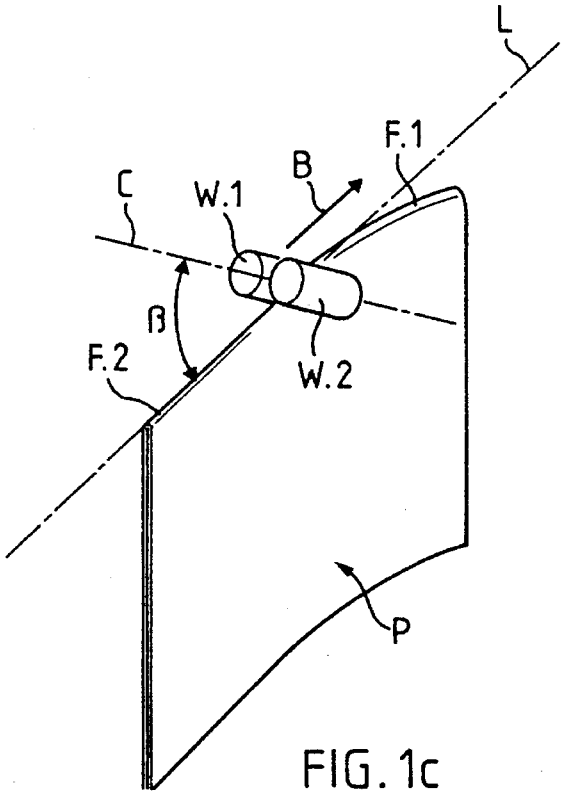

FIGS. 1*a* to 1*c* perspectively show a printed product P with a folded edge F to be creased and located on a line L. It e.g. consists of a plurality of centrally folded sheets placed in one another. According to the process of the invention one point of the folded edge F, e.g. its one end, is positioned between two creasing tools W.1 and W.2, so that said tools are positioned on either side of the folded edge and are urged toward one another, e.g. perpendicular thereto (arrows A) in FIG. 1*a*, until they engage on either side of the folded edge with their parallel creasing surfaces on a creasing point on the product and can additionally be pressed against one another. The creasing tools are then moved parallel to the line L (arrow B) along the folded edge (FIG. 1*b*).

The creasing tools W.1, W.2 are in this case constructed as two cylinders which are free or driven in rotary manner about the axis and which engage on the product along a line C (creasing line). As shown in FIG. 1*b*, the creasing line C can be directed perpendicular to the folded edge (or line L). However, as shown in FIG. 1*c*, it can also form an acute angle β with the folded edge (or line L), advantageously in such a way that the end of the creasing line resting on the product leads in the movement direction B. Thus, during the movement of the creasing tools in the direction B there is a force, which is directed from the product against the folded edge and which, during the creasing process, draws the folded edge outwards, which improves the crease quality.

The creasing surfaces of the creasing tools are, as will be explained in greater detail relative to FIGS. 2*a* to 2*d*, positioned in such a way that the folded edge at the creasing point is curved away from the line L, so that e.g. in the manner shown in FIGS. 1*b* and 1*c* the not yet creased part F.1 of the folded edge is moved away from the line L, while the creased part F.2 of the folded edge is located on the line L.

The description of the creasing process with the aid of lines L and C is theoretical and actually relates to a product, which at right angles to its main faces has no extension, i.e. no real thickness. In real cases the product with the folded edge to be creased has a finite thickness in such a way that on each side of the product a creasing line C is formed, between which passes the theoretical line L, without intersection points occurring. Additionally in the case of a real product, which comprises layers, the folded edge (line L) also has an extension against the head of the product, i.e. in actual fact each sheet has its own line L and the group of parallel lines L of the individual sheets are essentially located in a plane arranged centrally in the product. In order not to unnecessarily complicate the description, the theoretical product without a finite thickness is used as a basis here, i.e. reference is made to a line L, although in the case of a real product this represents an area, which through the thickness of the product and also by the superimposed individual folds, also has a transverse extension. The described intersection points with the theoretical line L are real intersection points with parallel lines to the theoretical line L in the indicated area of the folded edge.

The creasing tools pass over the entire folded edge creasing the edge by local bending and/or pressing. Except in the case of driven creasing tools, the creasing tools exert as a result of their movement along the folded edge a tension on the printed product, so that the latter must be secured by not shown holding means during the creasing operation. As a function of the printed product flexibility, the design of the creasing tools and the holding means and as a function of the way in which the printed product is secured, the folded edge is curved or bent around one of the creasing tools so that in the manner shown in FIGS. 1*b* and 1*c* the as yet uncreased part forms an angle to the already creased part, or in such a way that the as yet uncreased part is only slightly displaced with respect to the already creased part or, in addition to a further curvature, is substantially also located on the line L (cf. also FIG. 2*a*).

It is also conceivable that in place of moving creasing tools, which crease the folded edge of a stationary product, stationary pairs of creasing tools can be provided between which the product is e.g. drawn with the aid of holding means.

With a viewing angle on the folded edge of a printed product to be creased, FIGS. 2*a* to 2*d* show different embodiments of pairs of creasing tools W.1 and W.2. The creasing surfaces of the creasing tools, i.e. the surfaces acting on either side on the folded edge of the product during the creasing process and through which a pressing force is also exerted on the product, can be designed in such a way that this action is exerted on a very narrow area (creasing point) of the folded edge. For this purpose advantageously at least one of the creasing surfaces is curved in such a way that it acts on the product essentially along a line (line C in FIGS. 1*b* and 1*c*). However, narrow, planar creasing surfaces are also conceivable. Moreover, as stated, the creasing surfaces are advantageously so positioned relative to one another that the folded edge is curved away from the line L by the creasing tools. This is achieved in that the creasing surfaces are located at the creasing point obliquely and not parallel to the line L or the movement direction B of the creasing point, so that the action direction K of a pressing force, which is perpendicular to the creasing surfaces, forms an acute angle α with the arrow B or with the line L. The smaller the angle α and the smaller the radius of curvature of the folded edge produced by the creasing tools, the smaller the additional pressing force which can achieve a predetermined creasing quality. As a result of the curvature of the folded edge tensions are produced in the paper, which act in a similar way to pressing forces. Thus, as a function of the paper quality and the product thickness, it is easily possible to perform the creasing process with very small pressing forces or only with fed-in, but not pressing creasing tools.

Figure 2A:
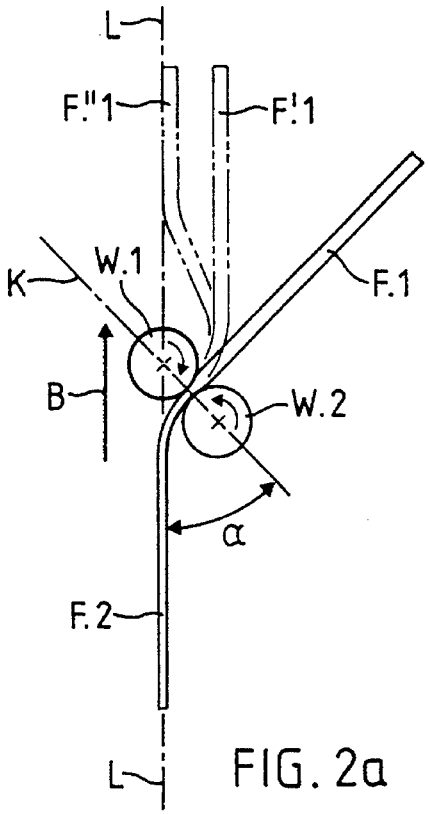
FIGS. 2*a* to 2*d* are plan views of various embodiments of pairs of creasing tools (viewing angle counter to the folded edge to be creased).

FIG. 2*a* shows an embodiment with two cylindrical creasing tools W.1 and W2, which are positioned on either side of the folded edge with axes parallel to one another and perpendicular to the said edge (arrangement as in FIG. 1*b*). The creasing surfaces are essentially the contact lines of the two cylinders and their immediate environment with a tangential plane (not shown), which is perpendicular to the connecting line of the two cylinder axes, said connecting line representing the action direction K of a pressing force. If the two tools are spaced from one another in the direction of the folded edge (line L), the action direction K of the pressing force is not perpendicular to the line L or to the movement direction B, so that between the creasing tools the folded edge is not only pressed but is also curved away from the line L. As a function of the arrangement and stiffness of the product, the still uncreased part of the folded edge will, as a result of the curvature, form (F1) an angle to the line L and after an opposite curvature will be substantially parallel thereto (F'.1) or be located on the line L (F".1). Only the local curvature of the folded edge between the creasing tools is relevant for creasing purposes. No significance is attached to the path of the as yet uncreased part of the folded edge.

The two cylindrical creasing tools can be free or driven in rotary manner about their axes or can be positioned in stationary manner relative to said axes. If the tools rotate, during the movement they roll along the folded edge on the printed product, whereas if they do not rotate they slide thereon and then the creasing surfaces can also be constructed as narrow, planar surfaces.

Figure 2B:
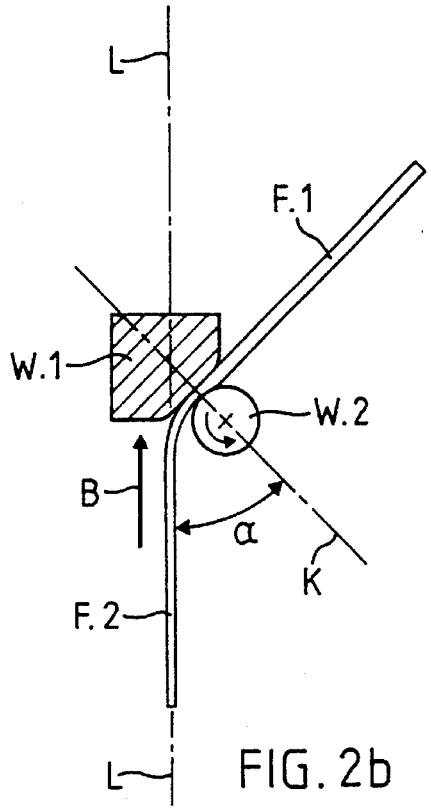

FIG. 2*b* shows a pair of creasing tools, whereof one (W.1) is constructed as a quasi-stationary meeting surface or countersurface, whilst the other (W.2) is cylindrical and rotary. The quasi-stationary countersurface is positioned obliquely to the line or the movement direction B, so that once again the action direction of the pressing force (line K) forms an acute angle α with the line L. The rotary tool rolls on the edge to be creased, while the latter slides on the creasing surface of the quasi-stationary tool.

Figure 2C:
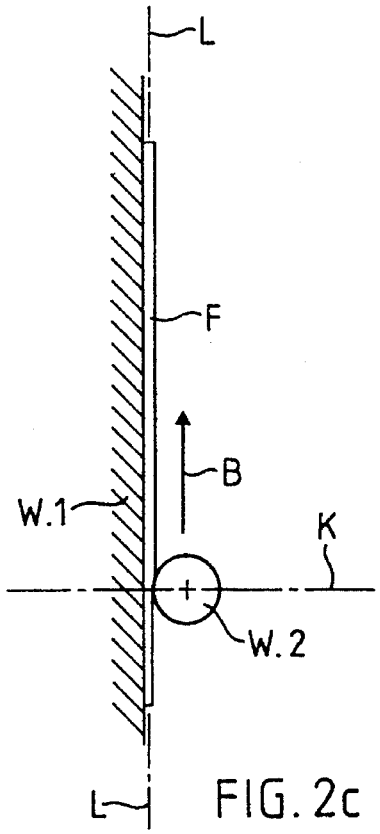

FIG. 2*c* shows the embodiment of the creasing tools derived by simplification from the embodiment of FIG. 2*b*. While one tool W.2 is once again cylindrical and e.g. rolls in the direction of the arrow B over the folded edge F, the other creasing tool W.1 is a countersurface, which is stationary with respect to the product and parallel thereto and which consequently does not move relative to the product. As the action direction K of the pressing force is at right angles to the movement direction B of the moving tool W.2, in this embodiment the folded edge of the product is only pressed, but is not bent, which in the case of comparable pressing forces leads to a less sharp crease.

Figure 2D:
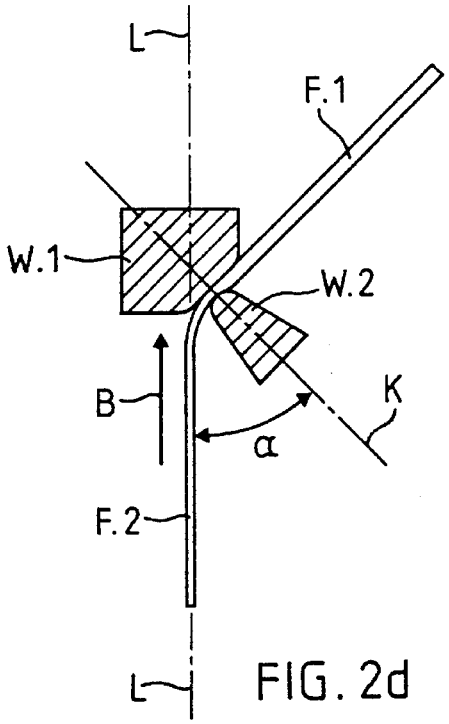

FIG. 2*d* shows a pair of non-rotary creasing tools (W.1, W.2), whose action can be compared with the creasing using a creasing leg (tool W.2) on a planar substrate (tool W.1). However, unlike in said process, the creasing leg (tool W.2) is moved in a direction B, which is not parallel to the substrate surface (tool W. 1). As a result, the folded edge is curved by the tools about the creasing leg (tool W.2), so that here again an additional pressing action can be very small or can be completely omitted.

Figure 3A:
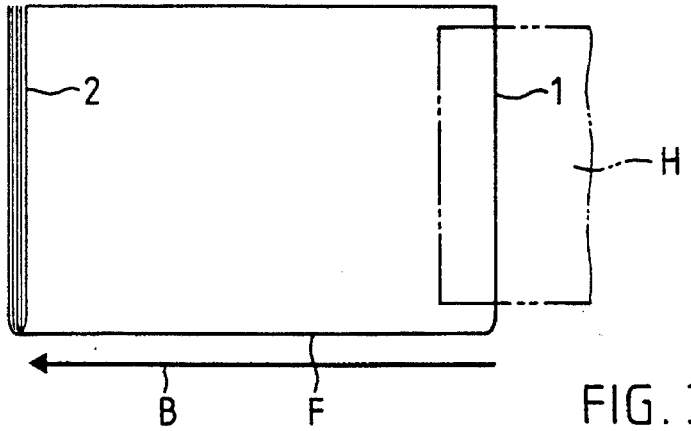
FIGS. 3*a* to 3*c* are diagrams illustrating engagement points of holding means and creasing tools on different printed products.
Figure 3B:
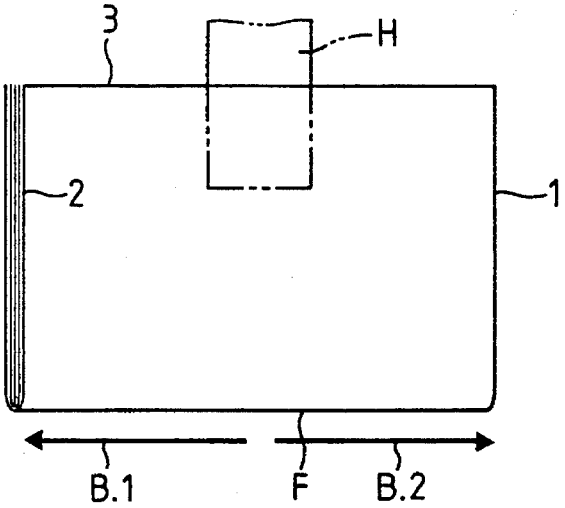
Figure 3C:
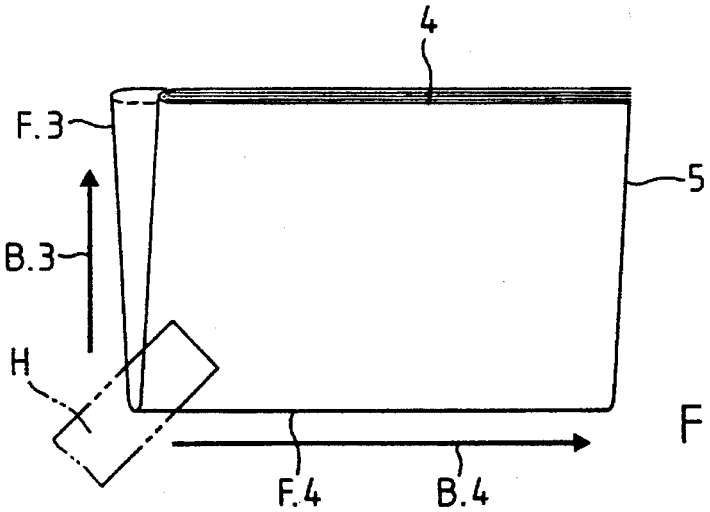

As the creasing tools exert a tension on the printed product due to their movement on rolling or sliding over the product in undriven manner, at least during the creasing process the printed product must be secured with holding means. The movement of the creasing tools and the holding means are so matched to one another that the printed products cannot be damaged by the creasing operation. The movement of the creasing tools is advantageously such that the creasing process on the folded edge ends where the folded edge strikes against a further product edge where the individual layers of the printed product are movable against one another. FIGS. 3*a* to 3*c* show different examples as to how printed products can be secured during the creasing process according to the invention.

FIG. 3*a* shows a once folded printed product with a folded edge F, which e.g. comprises several centrally folded sheets. As is diagrammatically shown, the product can e.g. be held with a holding means H along an edge 1, which bounds the folded edge F. The folded edge is then creased away from the holding means H against the edge 2 facing the held edge (arrow B). If the creasing process e.g. slightly deforms the outermost layer of the product, this will lead to a slight displacement of the edges of the individual layers of the product at the edge 2, which can be readily accepted.

FIG. 3*b* once again shows a once folded printed product, which is centrally held at the edge opposite to the folded edge F. So as to avoid forces acting on the printed product asymmetrically to the holding means H during creasing, use is made of two pairs of creasing tools, which move over the folded edge F in accordance with the arrows B.1 and B.2. In this way the creasing process takes up little time and any deformations which occur act on the two edges 1 and 2 bounding the folded edge, which compared with the embodiment according to FIG. 3*a* makes the action half smaller and consequently even less relevant. In order to achieve the same effect the product shown in FIG. 3*b* could also be held in the center of the folded edge F to be creased.

FIG. 3*c* finally shows a twice folded printed product, which has a first folded edge F.3 (first fold) and a second folded edge F.4 (second fold) adjacent thereto. In order to crease the two folded edges, it is particularly important that this is carried out with a movement B.3, B.4 of the creasing tools against the open edges 4 and 5, because even a slight deformation of the outermost layer of the product in the case of an opposite movement of the tools would lead to transverse folds in the vicinity of the product corner between the two folded edges (F.3, F.4). As shown, the holding means H must be positioned in said corner, unless the two folded edges are successively creased, a holding means then acting on one and then the other.

In the same way as a single or twice folded product, it is also possible to crease products which are folded more than twice. It is not a question of how strongly folded the products are prior to the creasing process. It is also conceivable that the products are not actually folded and are instead held together in such a way that a folded edge to be creased is precisely defined. This is e.g. the case with sheets whereof two facing edges are held together, so that the sheet is bent or quasi-folded along a central axis parallel to said edges, so that said axis is precisely defined as the folded edge or the edge to be creased.

Figure 4:
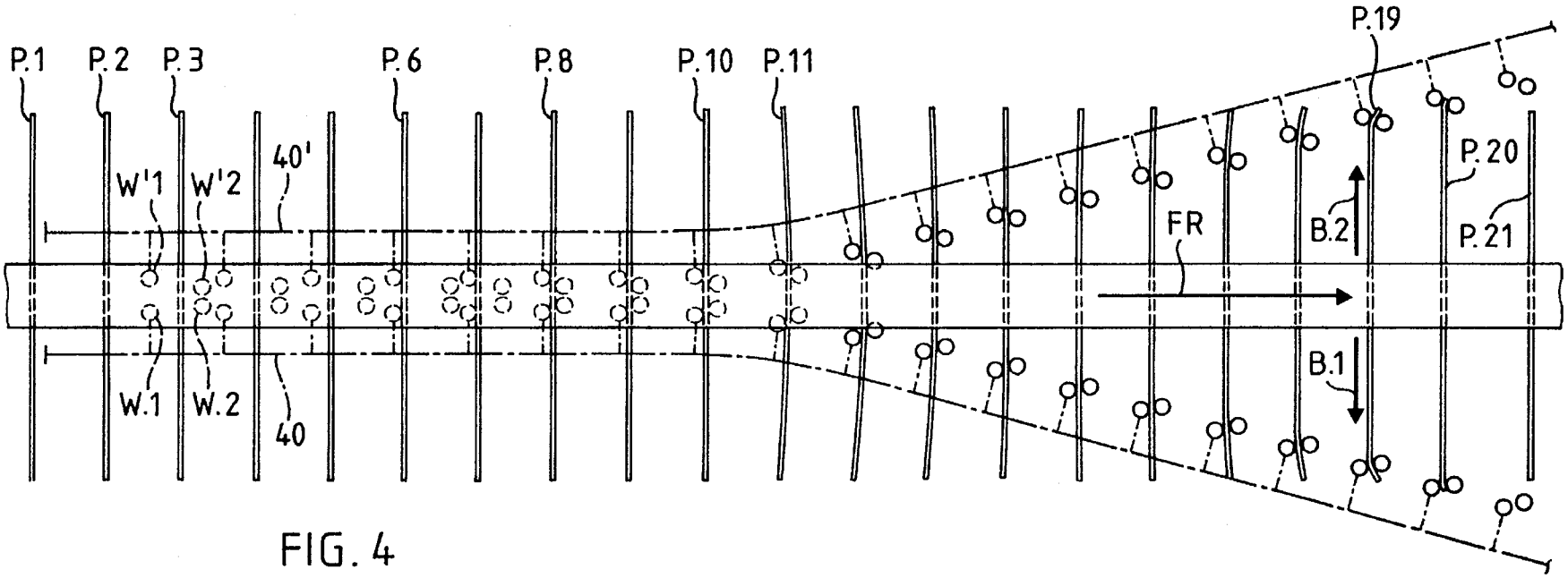
FIG. 4 is a plan view of an embodiment of the apparatus according to the invention for creasing a folded edge on products conveyed in continuous, suspended manner.
Figure 5:
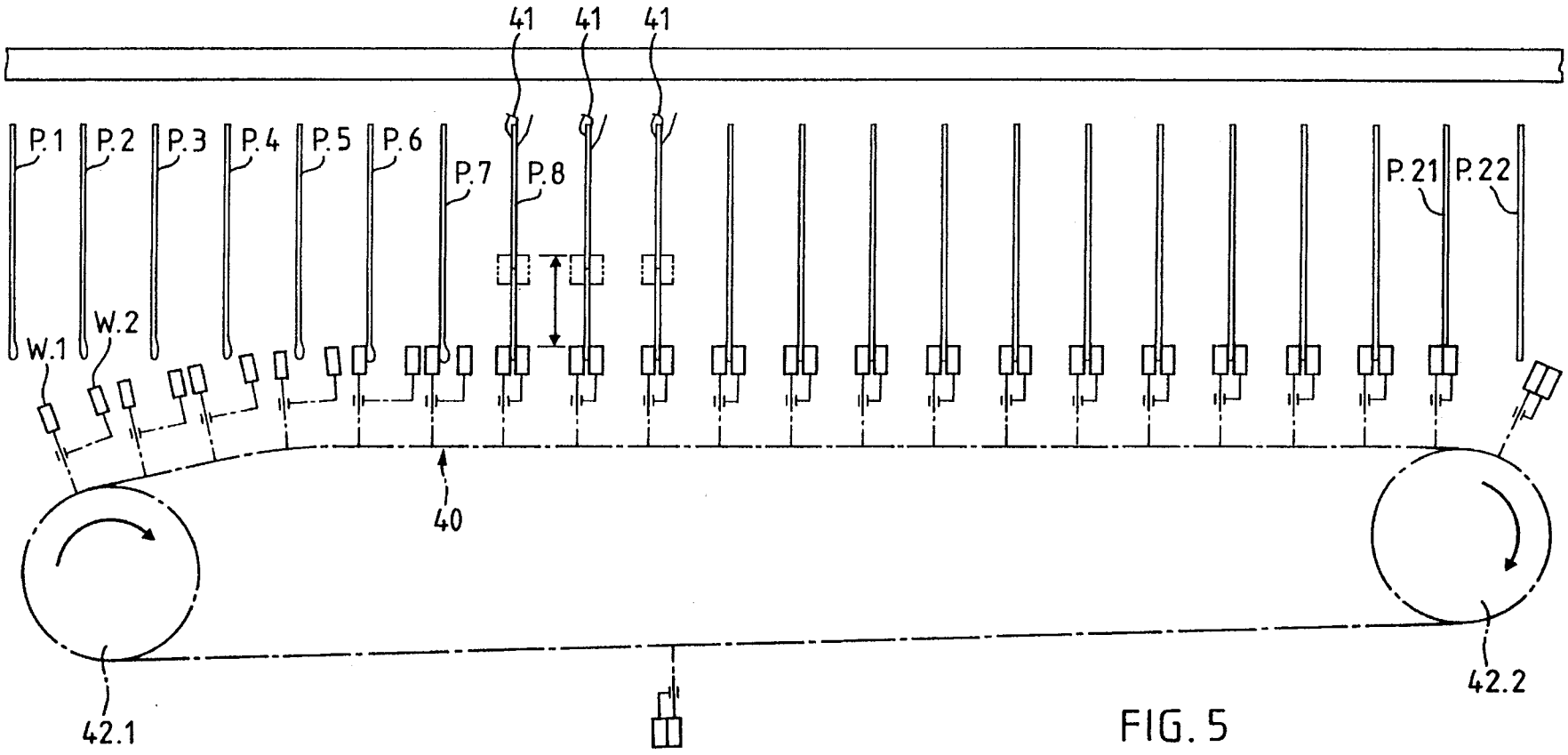
FIG. 5 is a side view of the apparatus according to FIG. 4.

FIGS. 4 and 5 show an embodiment of the apparatus according to the invention with which the folded edges of continuously conveyed printed products are creased according to the process of the invention. The printed products in single or multiply folded form, are held from above by holding means, which are simultaneously conveying means, in the manner shown in FIG. 3*b* and are conveyed with the folded edge hanging downwards, while two pairs of creasing tools are moved from the center of the edge to be creased toward the ends thereof. As shown in FIG. 2*a*, the creasing tools are in the form of pairs of cylindrical creasing rolls rotatable about their axes.

FIG. 4 shows the apparatus in plan view, it being possible to see the upper edges of the printed products P.1 to P.21 held by the centrally arranged, not shown holding and conveying means (41, in FIG. 5). The products are continuously conveyed in the direction of the arrow FR. The drawing constitutes an instantaneous photograph, in which the products P.3 to P.20 are located on the creasing line. In the vicinity of the products P.2 and P.3 two creasing tool pairs (W.1/W.2, W'.1/W'.2) are directed against the products from below and in the central areas of the folded edges for each product, the two tools of a pair being spaced from one another to such an extent that they can be readily introduced into the conveying stream. In the vicinity of the products P.6 the creasing tool pairs are positioned in the vicinity of the folded edges and are now brought together (cf. detail in FIG. 6). In the vicinity of the product P.8 the tools of each pair are positioned on the folded edge and can press same together. At product P.10 the tool pairs (W.1,/W.2, W'.1/W'.2) locally bending and/or pressing the folded edge start to move away from one another, i.e. on the movement thereof in the conveying direction FR is superimposed a movement in the direction B.1 or B.2. With product P.20 they reach the two ends of the folded edge and are led away laterally of the products (P.21).

The pairs of creasing tools are fitted with uniform spacings on a transfer means 40 or 40', e.g. on two correspondingly guided transfer chains, which are diagrammatically indicated in the drawing by in each case a dot-dash line.

FIG. 5 shows the apparatus according to FIG. 4 as a side view on which the printed products P.1 to P.22 are seen from a lateral edge. On the products P.8 to P.10 are diagrammatically shown holding/conveying means 41 in the form of clips or clamps, which hold the products at their upper edges and transfer the same, while the folded edges hang freely downwards.

Of these creasing tool pairs only those on one side (W.1/W.2) are visible. As stated, the pairs are fitted with identical spacings, which are substantially the same as the spacings between the holding means, to a transfer chain 40. The transfer chain is continuous and is driven by two guide pulleys 42.1, 42.2 in the direction indicated by the corresponding arrows and with substantially the same speed with which the holding means 41 are moved, so that the creasing tool pairs are moved substantially synchronously to the holding/conveying means. By corresponding, not shown guidance means, the two transfer chains 40 and 40' are held on the path shown in FIGS. 4 and 5 (dot-dash lines).

FIG. 5 clearly shows how the creasing tool pairs are introduced from below into the product feed stream in the vicinity of the products P.2 to P.6 and are positioned in the vicinity of the folded edges of the products, the creasing tools of a pair being spaced from one another. The movement of the creasing tool pairs is e.g. coordinated with the movement of the holding means 41 in such a way that one (W.1) of the creasing tools of a pair directly engages on the product, so that only the other (W.2) has to be moved for positioning for creasing purposes (cf. detail of FIG. 6).

In the vicinity of the products P.6 to P.8 the creasing tools of the pair are positioned for creasing and pressed against one another and in this position moved over the remainder of the creasing path in the manner shown in FIG. 4 and crease the folded edges. In the vicinity of the product P.21 the two corresponding creasing tool pairs have reached the end of the folded edge and are moved laterally from the product up to the guide pulley 42.2, where they start the return path.

In the vicinity of the products P.8 to P.10 the creasing tools are shown in dot-dash line form in a second position to show that the creasing tools can be fixed to the transfer chain 40 in such a way that their spacing can be adjusted by the latter. As a result the apparatus can be adapted in simple manner to different printed product formats. An identical adaptability can be achieved if the entire transfer or conveying means carrying the creasing tools is made adjustable in such a way that its spacing with respect to the product conveying means can be regulated.

There is no need to adapt the apparatus for slightly wider or narrower products (dimensioned transversely to the conveying direction) and the creasing process lasts a correspondingly longer or shorter time.

Figure 6:
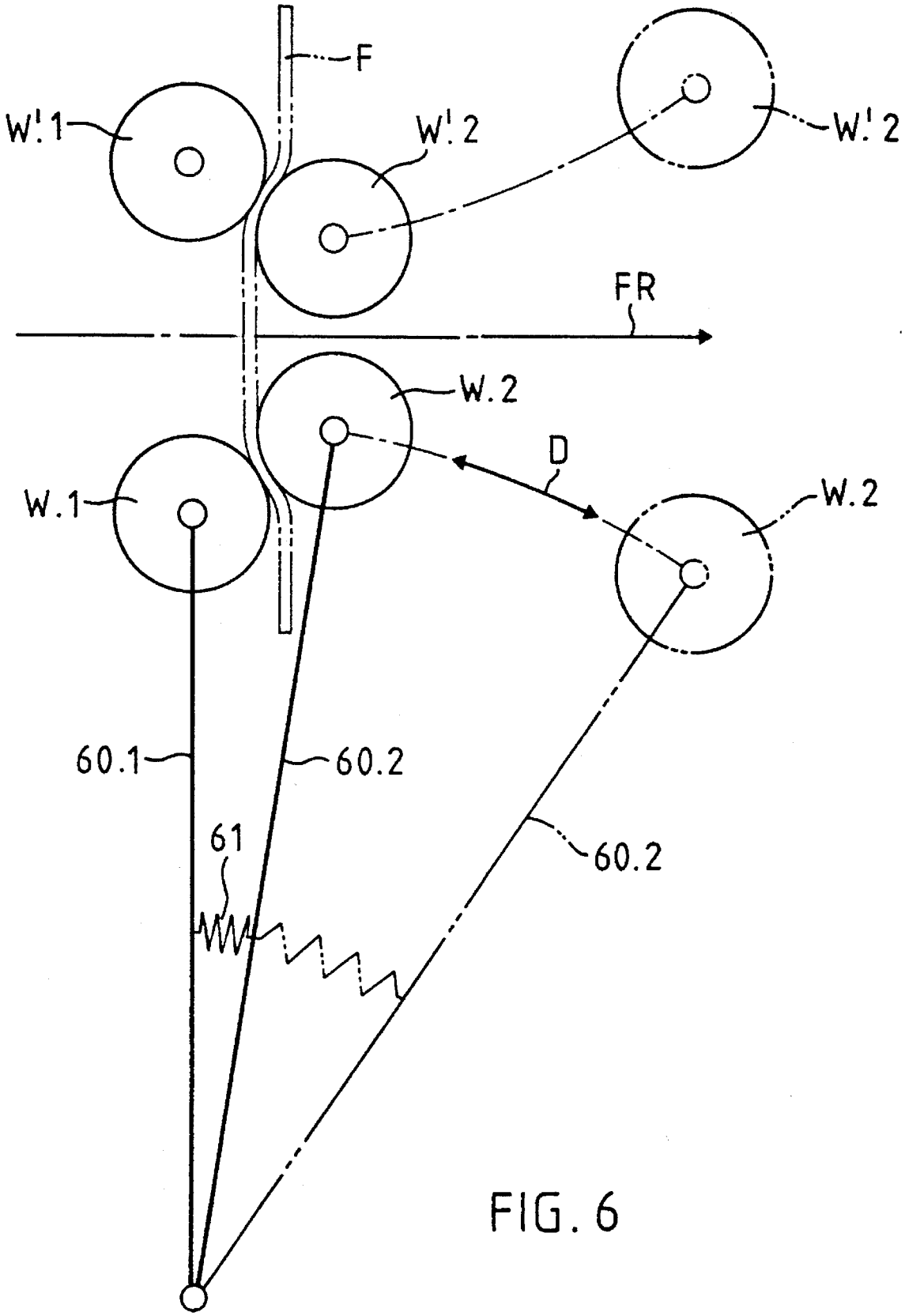
FIG. 6 is a detail of the apparatus according to FIG. 4.

FIG. 6 shows as a detail the relative movement of the two creasing tools W.1, W.2 or W'.1/W'.2 of a pair. It is a plan view like FIG. 4 and is also shown in the vicinity of products P.6 to P.8. The two creasing tools W.1 and W.2 of a pair are e.g. located on levers 60.1 and 60.2 which are pivotable against one another (double arrow D) and are pressed by a spring 61 into a position (creasing position, shown in continuous line form), in which the two tools are in contact and in which they are pressed against one another with a pressing force e.g. by the spring. By means of a not shown control link, which e.g. acts on the end of the tools remote from the folded edge, the two tools are moved into a spaced position (inoperative position, shown in dot-dash line form) counter to the tension of the spring 61, where they are held or again returned to the creasing position.

The control link is to be positioned in such a way that the creasing tools, prior to their introduction into the feed stream, are separated from one another (inoperative position), i.e. somewhere in the vicinity of the return path of the creasing tool pairs or in the vicinity of the reversal point (42.1, FIG. 5) prior to introduction, so that the creasing tools, during their introduction into the feed stream, remain in the reciprocally spaced inoperative position and on reaching their relative position with respect to the folded edge to be creased, are returned into the creasing position, i.e. in the vicinity of products P.6 to P.8 in FIGS. 4 and 5.

FIG. 6 makes it clear how the folded edge F to be creased is curved by the creasing tools.

The transfer chain, which drives the creasing tool pairs, fixes the creasing tool pairs to said transfer chain and also the mechanism of connecting the two creasing tools of a pair to the corresponding control link can be easily brought about by the expert and are therefore not shown and described in detail.

Figure 7:
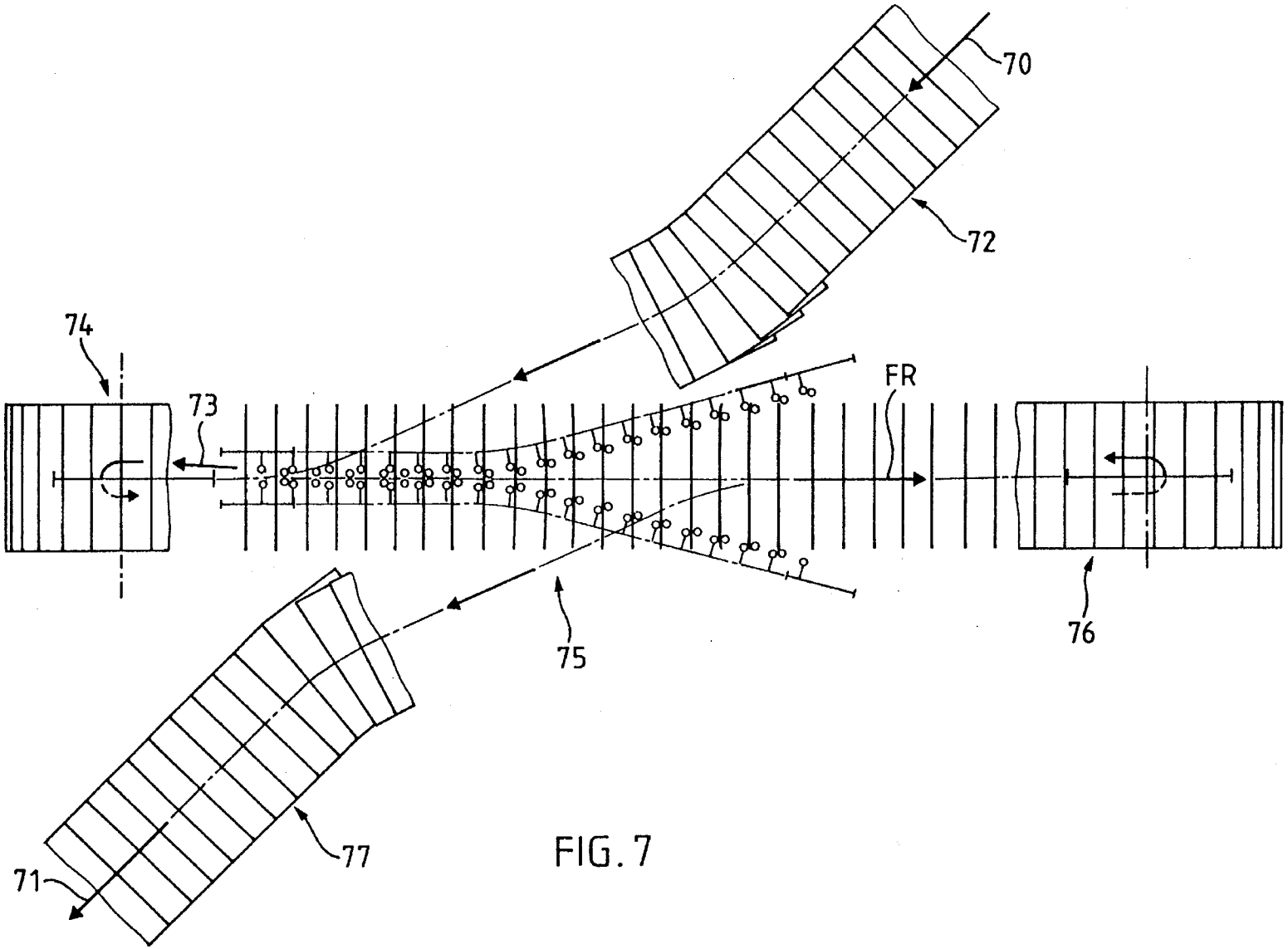
FIG. 7 is a schematic plan view of the apparatus according to FIG. 4 in a conveying path.

FIG. 7 schematically shows how the embodiment of the inventive apparatus according to FIGS. 4 and 5 can e.g. be incorporated into a transfer line for printed products in scale formation, without any significant lengthening thereof or without deflection in a specific direction. FIG. 7 is a plan view like FIG. 4. In the center it is possible to see the apparatus according to FIG. 4 with the reference numeral 75. The conveying direction of the transfer line is essentially that of the arrows 70 and 71, which indicate the direction of the supply and removal of the products.

The printed products are supplied by a conveying means in the form of an imbricated or scale flow 72 with top, leading folded edges to be creased. The scale flow 72 is transferred and deflected into a new conveying direction 73, which forms an acute angle to the supply conveying direction 70 and then turned by 180° in the downwards direction 74, so that the folded edges come to rest on the bottom of the stream. The now top edges of the products facing the folded edges are grasped and the products are conveyed in the suspended position in a direction FR opposite to the transfer direction 73 through the creasing apparatus in accordance with FIGS. 4 and 5 (75), while the freely downwardly hanging folded edges are creased according to the process of the invention. Following the creasing line the folded edges of the products are deflected by corresponding means in such a way that once again there is a scale flow with leading, top folded edges. This takes place by an upward deflection by 180° (76) into a scale flow 77, whose direction corresponds to the original direction 71 of the introduced scale flow 72.

The scale flow 77 passed out of the system differs from the scale flow 72 introduced into the system only through the creased folded edges.

The exemplified embodiment of the apparatus according to the invention described in conjunction with FIGS. 4, 5 and 6 is e.g. usable following an insertion or collecting process from which the end products are e.g. removed in suspended manner. An arrangement according to FIG. 7 is e.g. usable in the vicinity of the outlet point from a rotary press producing a scale flow.

The embodiment of the apparatus according to the invention described relative to FIGS. 4, 5, 6 and 7 is of an exemplified nature. Neither the suspended position of the products, nor the substantially horizontal direction of the creasing path, nor the arrangement of the creasing tools are prescribed. In the same way as the individual printed products can be creased in accordance with the process and apparatus of the invention, it is also possible to crease in the same way as a single product groups of printed products, whose folded edges to be creased are superimposed.

I claim:

1. A process for creasing paper printed products along a predetermined fold line comprising the steps of supplying a substantially continuously moving stream of paper printed products, each product having two main faces and a fold line along an edge to be creased between the main faces, the stream of products having a conveying direction and each product in the stream being oriented such that an extension of a fold line between said main faces of a respective product forms an angle with respect to the conveying direction;

simultaneously conveying a pair of creasing tools with each respective product in the stream, said pairs of creasing tools having creasing surfaces lying in planes parallel with each other, at least one of the creasing surfaces being elongated in one direction and relatively narrow a direction perpendicular to said one direction;

positioning a small portion of the edge to be creased between a pair of creasing tools with parts of the parallel creasing surfaces contacting the main faces of the product and the at least one elongated surface crossing the edge to be creased; and causing relative movement between each of the selected products and at least one of the creasing tools associated with each selected product so that the edge to be creased passes between the creasing surfaces of the associated pair of creasing tools to thereby form a crease along the edge as the stream continues to move.

2. A process according to claim 1 wherein the creasing surfaces define a creasing line therebetween, and wherein the step of positioning includes orienting the creasing tools of a pair of creasing tools so that the creasing line forms an angle of not less than 90° with an extension of the fold line in a direction of printed product relative movement.

3. A process according to claim 1 wherein a line perpendicular to the creasing surfaces and perpendicular to the direction of printed product relative movement forms an acute angle with a plane containing product not yet creased, thereby bending the edge to be creased.

4. A process according to claim 1 including pressing the tools of each pair toward each other while causing relative movement.

5. A process according to claim 1 including one tool of each pair in the form of a circular cylinder and mounting the cylindrical tool for free rotational movement during relative movement.

6. A process according to claim 1 and including one tool of each pair in the form of a circular cylinder, and rotationally driving the cylindrical tool during relative movement.

7. A process according to claim 1 and including suspending each printed product from a holding means during creasing.

8. A process according to claim 1 including holding each product with a holding means along an edge intersecting the edge to be folded during movement in the stream, and wherein, during the relative movement between the product and the creasing tool along the edge to be creased, the direction of movement of the tool is away from the holding means.

9. A process according to claim 1 including holding each product with a holding means intermediate ends of the edge to be folded during movement in the stream, and wherein, during the relative movement between the product and the creasing tool along the edge to be creased, two pairs of tools are moved along the edge to be folded and the direction of movement of the tools is away from the holding means.

10. A process according to claim 1 wherein the products each have two edges to be folded, the two edges intersecting at a product corner and including holding each product with a holding means at the product corner during movement in the stream, and wherein, during the relative movement between the product and the creasing tool along the edge to be creased, two pairs of tools are moved along the edges to be folded and the direction of movement of the tools is away from the holding means.

11. A process according to claim 1 wherein the stream of paper printed products comprises a scale flow of overlapping, folded printed products, wherein the step of supplying comprises conveying the stream in a first conveying direction with the products arranged with folded edges as leading edges, deflecting the flow away from the first conveying direction, and engaging and lifting trailing edges of each product with a holding means so that the products are individually freely hanging;

wherein the step of causing relative movement includes creasing edges of the products opposite edges held by the holding means, the process further comprising after the step of causing relative movement, releasing the held edges so that the products with creased edges are placed on a conveyor in an overlapping stream, and again deflecting the direction of flow to a direction parallel with the first conveying direction.

12. A process according to claim 11 and including prefolding and assembling individual sheets of paper to form each of the printed products before forming the scale flow thereof.

13. An apparatus for creasing paper printed products along a predetermined fold line comprising the combination of conveyor means carrying in a conveying direction a substantially continuously moving stream of paper printed products, each product having two main faces and a fold line between the main faces along an edge to be creased, each product in the stream being oriented such that an extension of a fold line between said main faces of a respective product forms an angle with respect to the conveying direction;

a plurality of pairs of creasing tools each having creasing surfaces lying in planes parallel with each other, at least one of the creasing surfaces being elongated in one direction and relatively narrow in a direction perpendicular to said one direction; and means for moving a pair of said creasing tools with a printed product and for causing relative movement between said product and at least one creasing tool of said pair so that said edge to be creased passes between creasing surfaces of said pair of creasing tools to thereby form a crease along the edge as the stream continues to move.

14. An apparatus according to claim 13 wherein said creasing surface of at least one of said creasing tools in each pair is curved so that an effective creasing surface of said at least one tool is essentially a line.

15. An apparatus according to claim 13 and further including holding means for grasping and lifting individual products for creasing with said creasing tools, said holding means and said tools being supported so that said creasing tool is not perpendicular to said edge to be creased.

16. An apparatus according to claim 15 wherein centers of said tools in said pair of tools lie on a line forming an acute angle with a direction of relative movement between said product and said creasing tool.

17. An apparatus according to claim 15 wherein one tool of said pair of tools is a freely rotatable roller.

18. An apparatus according to claim 17 wherein the other of said pair of tools is a freely rotatable roller.

19. An apparatus according to claim 17 wherein the other of said pair of tools is a non-rotatable tool shaped to conform to and cooperate with said roller.

20. An apparatus according to claim 15 wherein one tool of said pair of tools is a roller, said apparatus including means for rotationally driving said roller.

21. An apparatus according to claim 20 wherein the other of said pair of tools is a freely rotatable roller.

22. An apparatus according to claim 20 wherein the other of said pair of tools is a non-rotatable tool shaped to conform to and cooperate with said roller.

23. An apparatus according to claim 15 wherein said holding means comprises a gripper chain and a plurality of grippers mounted on said gripper chain.

24. An apparatus according to claim 15 and further comprising an endless chain, said pairs of creasing tools being attached to said chain, said creasing tools and said holding means being spaced apart by equal distances.

25. An apparatus according to claim 15 and including spring means urging said creasing tools of each pair of creasing tools toward each other, and control means for selectively separating said creasing tools counter to said spring means.

* * * * *